US010524584B2

(12) United States Patent
Basset

(10) Patent No.: US 10,524,584 B2
(45) Date of Patent: Jan. 7, 2020

(54) MULTILAYER FURNITURE PROTECTIVE DEVICES AND METHODS OF USE

(71) Applicant: Elan Basset, San Diego, CA (US)

(72) Inventor: Elan Basset, San Diego, CA (US)

( * ) Notice: Subject to any disclaimer, the term of this patent is extended or adjusted under 35 U.S.C. 154(b) by 784 days.

(21) Appl. No.: 14/880,117

(22) Filed: Oct. 9, 2015

(65) Prior Publication Data

US 2017/0099958 A1 Apr. 13, 2017

(51) Int. Cl.

| | |
|---|---|
| ***B65D 25/20*** | (2006.01) |
| ***A47C 31/10*** | (2006.01) |
| ***B65D 81/03*** | (2006.01) |

(52) U.S. Cl.

CPC ..... *A47C 31/10* (2013.01); *B65D 81/03* (2013.01)

(58) Field of Classification Search

CPC ..... B65D 81/3876
USPC ..... 428/34.1, 35.7; 119/51.04
See application file for complete search history.

(56) References Cited

U.S. PATENT DOCUMENTS

2011/0056969 A1* 3/2011 Crain ..... B65D 81/3876 220/739

FOREIGN PATENT DOCUMENTS

EP 638483 * 2/1995

* cited by examiner

*Primary Examiner* — Ellen S Wood
(74) *Attorney, Agent, or Firm* — Franklin & Associates International Inc; Matthew F. Lambrinos

(57) ABSTRACT

Multilayer furniture protective devices and methods of use are provided herein. An example furniture protective device includes a tubular sleeve having a first open end and a second open end. The tubular sleeve has a layered pair of substrates including an elastomeric sheet stitched to a polymeric fabric sheet. The elastomeric sheet is stitched using a diamond pattern and the polymeric fabric sheet has a stitched diamond pattern that forms cells. Each of the cells has a ruching of polymeric fabric sheet material. The cells can expand when the furniture protective device is stretched due to the ruching of polymeric fabric sheet material allowing the tubular sleeve to expand to encompass an article of furniture. The elastomeric sheet resiliently biasing the tubular sleeve into a conforming relationship around the article of furniture.

16 Claims, 8 Drawing Sheets

700

900

MULTILAYER FURNITURE PROTECTIVE DEVICES AND METHODS OF USE

CROSS REFERENCE TO RELATED APPLICATIONS

N/A

FIELD OF THE PRESENT TECHNOLOGY

Embodiments are directed to furniture protective devices, and more specifically but not exclusively to furniture protective devices for protecting furniture during storage or transportation. Alternatively or additionally, embodiments relate to methods for protecting articles of furniture.

SUMMARY OF THE PRESENT TECHNOLOGY

According to one aspect, a furniture protective device may comprise a tubular sleeve comprising a first open end and a second open end, the tubular sleeve comprising a layered pair of substrates comprising an elastomeric sheet stitched to a polymeric fabric sheet, wherein the elastomeric sheet is stitched to the polymeric fabric sheet with a pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass an article of furniture, the elastomeric sheet resiliently biasing the tubular sleeve into a conforming relationship around the article of furniture.

According to some embodiments, the present technology may be directed to a furniture protective device, comprising a tubular sleeve comprising a first open end and a second open end, the tubular sleeve comprising a layered pair of substrates comprising an elastomeric sheet stitched to a polymeric fabric sheet, wherein the elastomeric sheet is stitched to the polymeric fabric sheet with a diamond pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass an article of furniture, the elastomeric sheet resiliently biasing the tubular sleeve into a conforming relationship around the article of furniture.

According to some embodiments, the present technology may be directed to a furniture protective device, comprising a tubular sleeve comprising a first end and a second end, the tubular sleeve comprising a layered pair of substrates comprising an elastomeric sheet stitched to a polymeric fabric sheet, wherein the elastomeric sheet is stitched to the polymeric fabric sheet with a diamond pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass an article, the elastomeric sheet resiliently biasing the tubular sleeve into a conforming relationship around the article.

According to some embodiments, the present technology may be directed to a method comprising: (a) obtaining a tubular sleeve comprising a first open end and a second open end, the tubular sleeve comprising a layered pair of substrates comprising an elastomeric sheet stitched to a polymeric fabric sheet, wherein the elastomeric sheet is stitched to the polymeric fabric sheet with a diamond pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass the article of furniture, the elastomeric sheet resiliently biasing the tubular sleeve into a conforming relationship around the article of furniture; (b) placing the first end over the article of furniture; and (c) sliding the tubular sleeve over the article of furniture so that the tubular sleeve is placed into conforming relationship around the article of furniture.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1A:
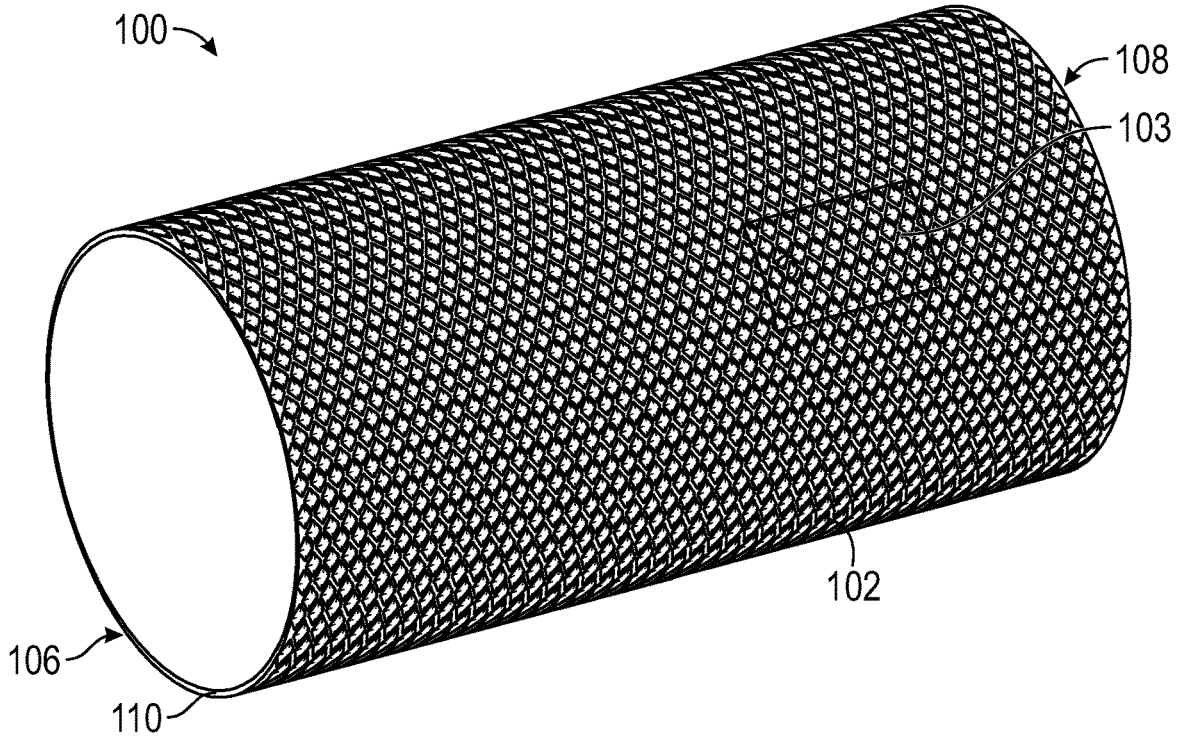
FIG. 1A is a perspective view of an embodiment of a furniture protective device.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the present technology. As used herein, the singular forms “a”, “an” and “the” are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

When moving articles of furniture, care must be taken to avoid damaging the articles of furniture. In some instances, the articles of furniture are wrapped with shrinking plastic wrap or covered with blankets or other textile materials and shrink wrapped to compress the materials against the articles of furniture. These methods are disadvantageous because they are extremely time consuming. Also, these methods are non-desirous because they often fail to cover or protect the articles of furniture from damage due to scratching, impacts, and the like.

The present disclosure is directed to furniture protective devices, and more specifically to resilient and expandable furniture protective devices that expand to encompass all or part of an article of furniture, while compressively conforming against the article of furniture. Also, while the furniture protective device can be used to cover furniture, the furniture protective device can likewise be adapted to conformingly cover any object desired.

A furniture protective device according to one embodiment can include a multilayer configuration having at least a polymeric fabric outer layer and an elastomeric layer. The polymeric fabric outer layer allows the furniture protective device to expand while the elastomeric layer functions to compress against the article of furniture to protectively cover the furniture protective device.

In some embodiments, the polymeric fabric outer layer is stitched to the elastomeric layer to create cells of ruching material that flatten out when the furniture protective device is stretched.

According to some embodiments, the furniture protective device can comprise one or more pouches that provide a means for storing furniture accessories and the like.

In one embodiment, the polymeric fabric outer layer can be manufactured from a colored textile and/or manufactured in different sizes to accommodate different sizes of articles of furniture.

These and other advantages of the present technology will be described in greater detail herein with reference to the collective drawings.

Figure 3:
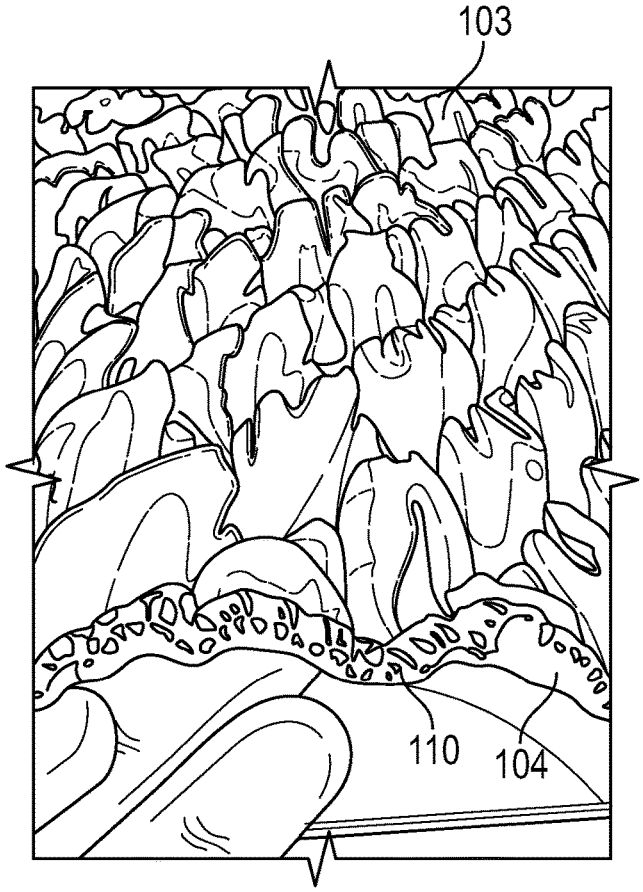
FIG. 3 is a perspective view of an end of a furniture protective device illustrating cells with ruching and a stitched terminal end according to an embodiment.
Figure 4:
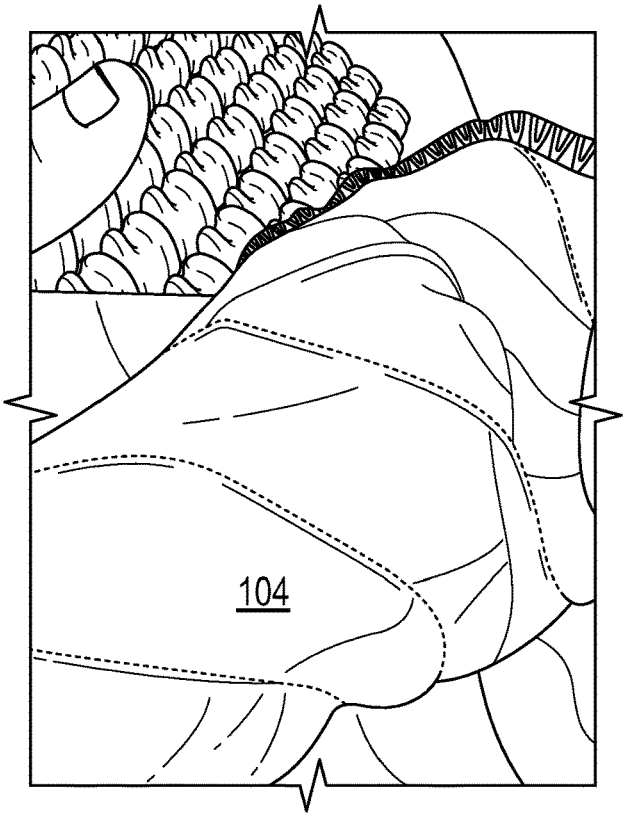
FIG. 4 is a perspective view of an elastomeric sheet of a furniture protective device according to an embodiment.

FIG. 1A is a perspective view of an example furniture protective device (hereinafter "device 100"), constructed in accordance with the present technology. The device 100 is configured as a tubular sleeve comprised of a layered pair of substrates. In one embodiment, a polymeric fabric outer layer 102 and elastomeric inner layer 104 (as best illustrated in FIGS. 3-4) are utilized.

In some embodiments, the polymeric fabric outer layer 102 can be constructed from, for example, a polyester fabric, although other polymeric fabric/textile material can also be utilized. In some embodiments, a more durable and puncture resistant material such as a woven manmade textile can be utilized to prevent punctures, tears, cuts, or other abrasions.

According to some embodiments, the polymeric fabric outer layer 102 comprises one or more pockets 103 that are configured to allow a user to store objects therein. In one embodiment, the pocket 103 can be used to store hardware or other ancillary parts of the article of furniture.

The device 100 has a first open end 106 and a second open end 108. In some embodiments, the first open end 106 and the second open end 108 each have a stitched peripheral edge, such as stitched peripheral edge 110 (see FIG. 3) of first open end 106. While only the first open end 106 is illustrated, it will be understood that the second open end 108 is identical in configuration to the first open end 106, including the same type of stitching as the stitched peripheral edge 110 of first open end 106.

In some embodiments, the stitched peripheral edges of the first open end 106 and the second open end 108 will function to constrict the ends when one of the ends extends past an end of the article of furniture.

Figure 2:
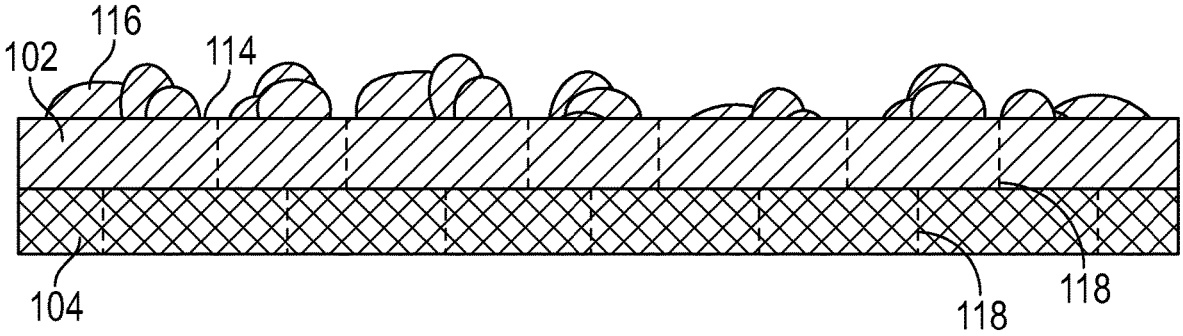
FIG. 2 is a cross section view of the furniture protective device of FIG. 1.

Turning to FIGS. 2 and 3, the elastomeric inner layer 104 can be constructed from a LYCRA material or other suitable elastomeric material that provides resiliency in response to stretching. The use of a polymeric material in the outer layer and the elastomeric material in the elastomeric inner layer 104 allows the device 100 to breathe, preventing moisture from being kept in contact with the article of furniture, which can lead to mold, rot, or other damage. Moisture can escape through the layers of the device 100 allowing the article of furniture to remain dry.

Because the elastomeric inner layer 104 is configured to conform against an article of furniture when the device 100 covers the article of furniture, the elastomeric inner layer 104 can be soft to prevent or reduce scratching of surfaces such a wood surfaces or glass of the article of furniture.

Figure 1B:
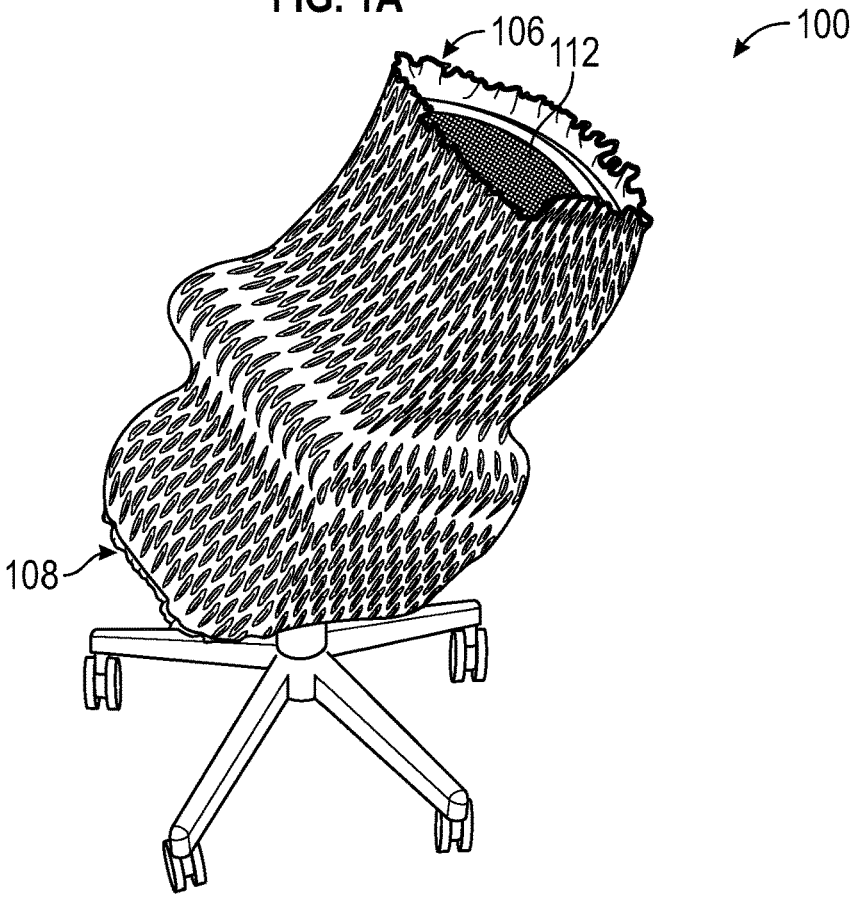
FIG. 1B is a perspective view of the furniture protective device in association with an article of furniture.

As illustrated in FIG. 1B, the device 100 covers a chair 112. Because the first open end 106 extends above an upper end of the chair 112, the first open end 106 is drawn together to purse the first open end 106 around the upper end of the chair 112, effectively wrapping the upper end of the chair 112. The second open end 108 can function in the same way as the first open end 106.

Returning back to FIG. 2, a cross sectional view of the device 100 illustrating the polymeric fabric outer layer 102 and the elastomeric inner layer 104 is provided. The cells, such as cell 114 are illustrated with the respective ruching 116.

According to some embodiments, the polymeric fabric outer layer 102 is stitched or otherwise joined to the elastomeric inner layer 104 to produce cells, such as cell 114 with ruching material 116 disposed therein. Again, the ruching material 116 is a gathering of a portion of the material of the polymeric fabric outer layer 102. The cells allow the device 100 to expand as the device 100 is pulled over an article of furniture.

In some embodiments, the stitching 118 used to join the polymeric fabric outer layer 102 with the elastomeric inner layer 104 is made from an elastic/resilient material. In some embodiments, the stitching 118 is sufficiently lose to allow the cells to expand or contract as required.

FIG. 3 illustrates the stitched peripheral edge 110 of first open end 106, illustrating the interface between the polymeric fabric outer layer 102 is stitched and the elastomeric inner layer 104.

FIG. 4 illustrates the elastomeric inner layer 104, which also has a diamond shaped stitching pattern that produces cells. As mentioned above, the elastomeric material in the elastomeric inner layer 104 is selected for softness and elasticity.

Figure 5:
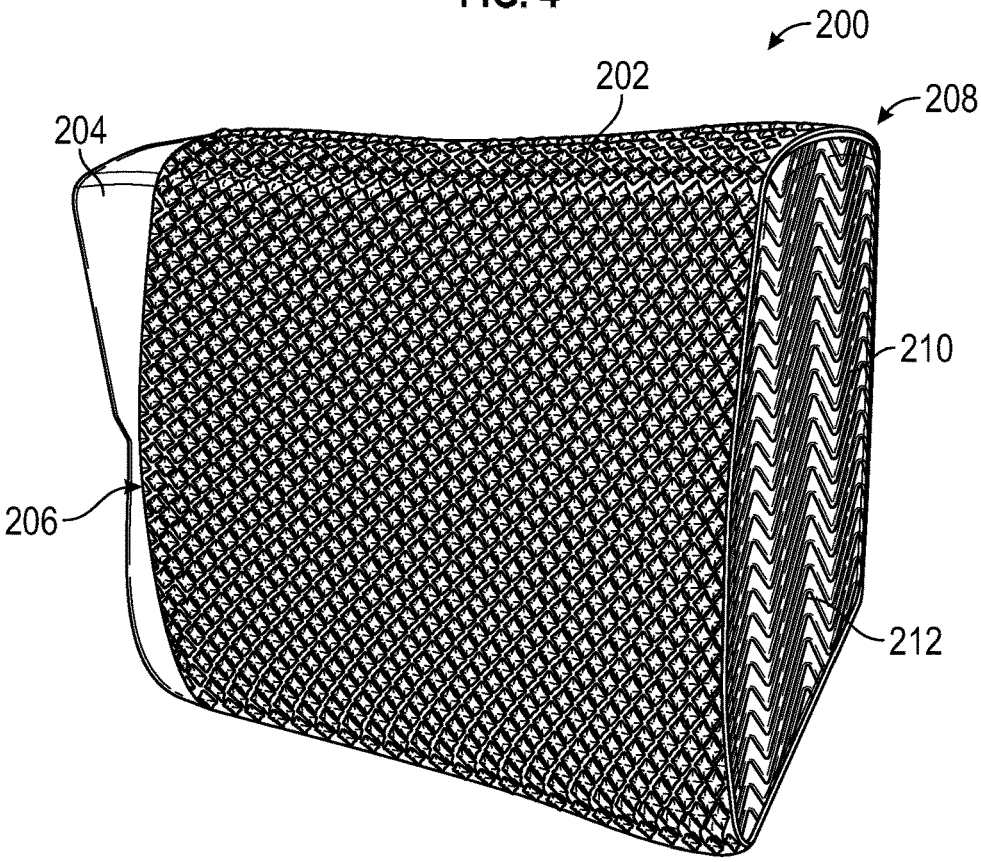
FIG. 5 is a perspective view of an embodiment of a furniture protective device in association with an article of furniture.

FIG. 5 illustrates another example embodiment of an example furniture protective device (hereinafter "device 200"), constructed in accordance with the present technology.

The device 200 is configured as a tubular sleeve comprised of a layered pair of substrates. In one embodiment, a polymeric fabric outer layer 202 and elastomeric inner layer (not illustrated) are utilized.

In some embodiments, the polymeric fabric outer layer 202 can be constructed from, for example, a polyester fabric, although other polymeric fabric/textile material can also be utilized. In some embodiments, a more durable and puncture resistant material such as a woven manmade textile can be utilized to prevent punctures, tears, cuts, or other abrasions.

The elastomeric inner layer can be constructed from a LYCRA material or other suitable elastomeric material that provides resiliency in response to stretching. The use of a polymeric material in the outer layer and the elastomeric material in the elastomeric inner layer allows the device 200 to breathe, preventing moisture from being kept in contact with the article of furniture, which can lead to mold, rot, or other damage. Moisture can escape through the layers of the device 200 allowing the article of furniture to remain dry.

Because the elastomeric inner layer is configured to conform against an article of furniture 204 when the device 200 covers the article of furniture 204, the elastomeric inner layer can be soft to prevent or reduce scratching of surfaces such a wood surfaces or glass of the article of furniture.

In some embodiments, the device 200 has a first open end 206 and a second closed end 208. The second closed end 208 is closed with a bottom sidewall 210. The bottom sidewall 210 can be constructed from a strong and resilient textile or fabric. In some embodiments, the bottom sidewall 210 provides an additional protective surface for covering an end of the article of furniture 204.

According to some embodiments, the bottom sidewall 210 is constructed with stitching to create chevron patterned cells 212. These chevron patterned cells 212 provide additional padding and structure to the bottom sidewall 210.

Figure 6:
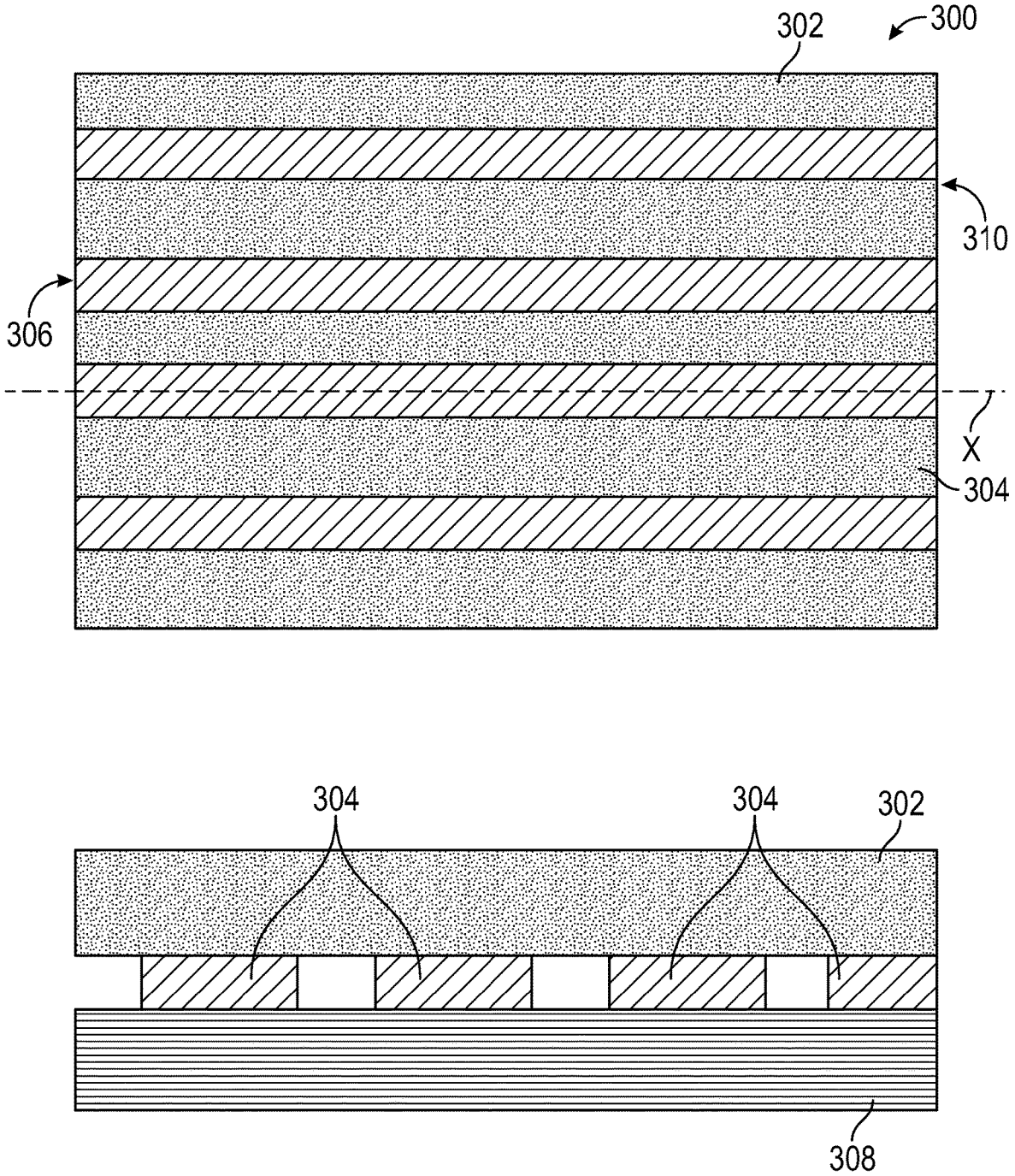
FIG. 6 is a top down partial view of another furniture protective device with a plurality of elastomeric bands associated with an elastomeric sheet, as well as a cross sectional view of the example furniture protective device, according to an embodiment.

FIG. 6 illustrates a portion of another example furniture protective device (hereinafter "device 300"), constructed in accordance with the present technology.

The device 300 comprises both a polymeric fabric outer layer 302 and elastomeric inner layer 308. The device 300 can be configured into a tubular sleeve configuration, although in FIG. 6 the polymeric fabric outer layer 302 is illustrated in a flat configuration. Also, the elastomeric inner layer has been removed in FIG. 6 to illustrate the use of elastic bands 304, which extend from a first end 306 to a second end 310. To be sure, device 300 is illustrated in a flat configuration, thus the first and second ends are laid flat as well. The first end and second end become "open" ends when the layers are wrapped into a tubular sleeve configuration.

The elastic bands 304 provide an additional layer of resiliency within the device 300. The elastic bands 304 can function to constrict the overall size of the device 300 when not in use.

In some embodiments, the elastic bands 304 extend longitudinally along a central axis X of the tubular sleeve in between the elastomeric sheet 308 and the polymeric fabric sheet 302 (outer layer). In another embodiment, the spaced elastic bands each extend circumferentially around the sleeve in between the elastomeric sheet 308 and the polymeric fabric sheet 302.

In use, a user will obtain a furniture protective device of the present technology. To install, the user can expand one of the open ends of the device so as to receive an article of furniture. The user can expand the first open end to receive a back of a chair. The user then slides the furniture protective device (tubular sleeve) over the remainder of the chair to place the device into conforming relationship around the article of furniture. Again, the elastic layer of the device advantageously causes the device to conform protectively around the article of furniture.

Figure 7:
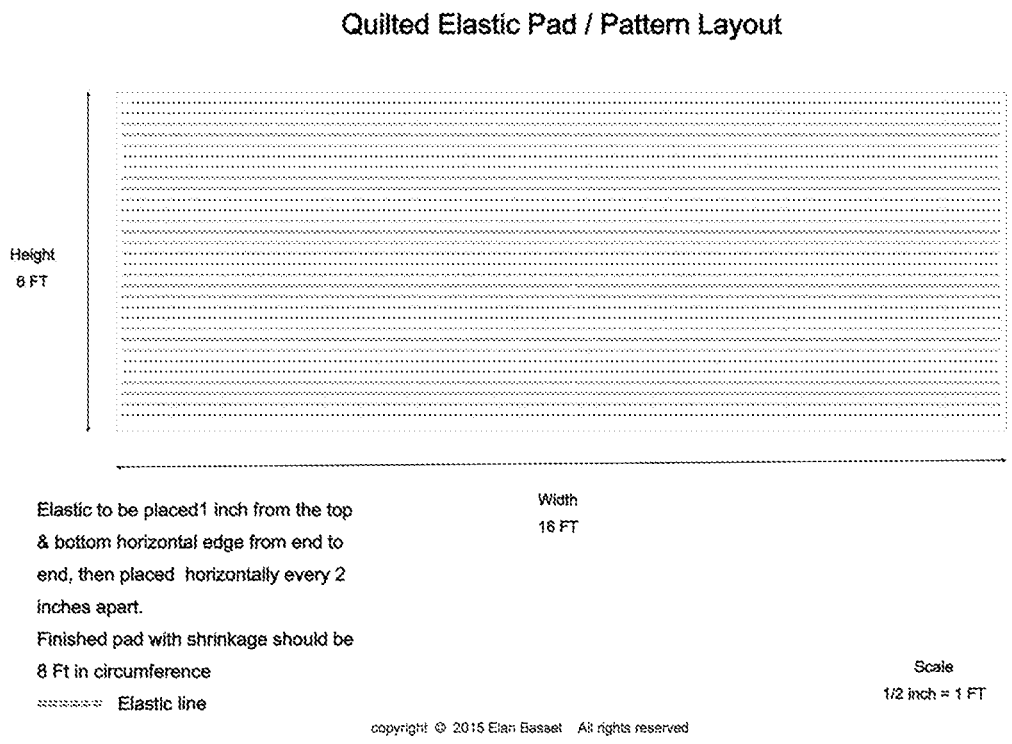
FIG. 7 is a top down view of a furniture protective device, illustrating a quilted elastic pattern layout according to an embodiment.

FIG. 7 is a top down view of a furniture protective device 700, illustrating a quilted elastic pattern layout according to an embodiment. The furniture protective device 700 is constructed similarly to the furniture protective device of FIGS. 1A-5 with the exception that elastic is placed one inch from a top edge and bottom edge. Elastic bands are also placed horizontally and spaced apart from one another at approximately two inch increments.

Figure 8:
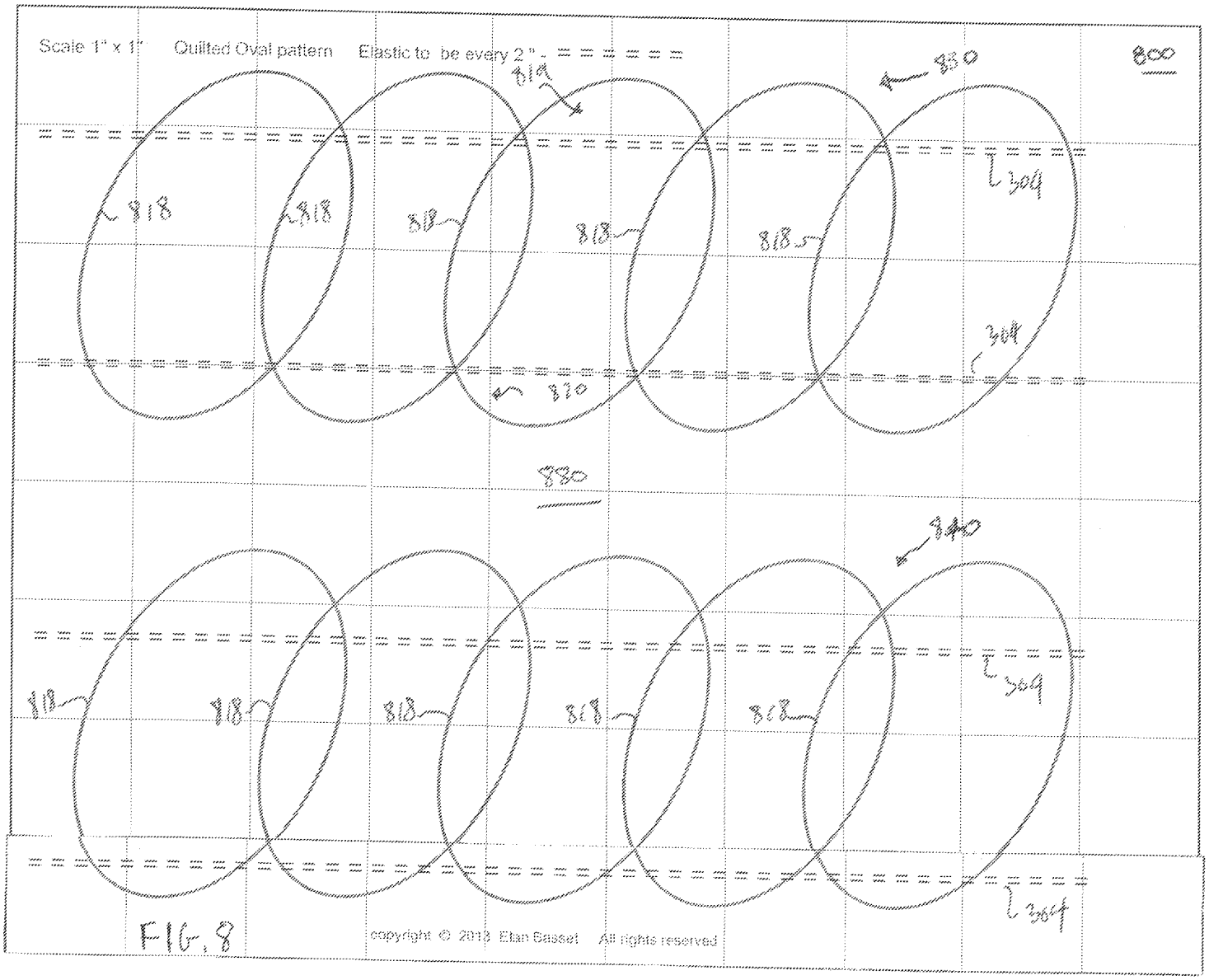
FIG. 8 is a top down view of an example quilted oval pattern for another furniture protective device according to an embodiment.

FIG. 8 is a top down partial view of a furniture protective device 800 having a quilted oval pattern according to an embodiment. Embodiments of device 800 have the same structure as any embodiment of FIGS. 1A-6, with the exception that the diamond shaped stitches 118 are replaced with overlapping oval stitching 818. Note that the square matrix shown in FIG. 8 is for the purpose of showing scale only and does not form part of the design.

Overlapping oval stitching 818 of the polymeric fabric outer layer to the elastomeric inner layer provides cells, with ruching material disposed therein, provides enhanced strength to the device whilst allowing the device to expand as the device is pulled over the article of furniture. In one embodiment, each individual oval stitching overlaps the next to form a chain or row 830, 840 of overlapping oval shaped stitching 818, the rows extending circumferentially around the tubular sleeve. Rows 830, 840 of overlapping oval shaped stitches 818 are spaced apart from one another and extend substantially in parallel to one another such that a stripe or region 880 of the device material absent any oval stitching 818 extends between row 830 and 840. In one embodiment, one or more elastic bands 304 extend along each row 830 and 840 of overlapping oval shaped stitches and circumferentially around the sleeve, in between the elastomeric sheet and the polymeric fabric sheet. In the embodiment of FIG. 8, a pair of spaced apart elastic bands 304 extend substantially in parallel and extend along the opposite outer edges of row 830. A first one of the pair of elastic bands 304 extends along a first outer side edge region 819 of the row 830 and in vicinity of the intersections of adjacent oval stitches 818 in said first outer side edge region. Similarly, the second one of the pair of elastic bands 304 extends along a second outer side edge region 820 of row 830 and in vicinity of the intersections of adjacent oval stitches 818 in the first outer side edge region 820, the second outer side edge region 820 being opposite the first outer side region 819. The configuration of row 840 and bands 304 is substantially similar to that of row 830 and bands 304.

The aforementioned spaced apart rows of overlapping oval stitching together with stripes therebetween absent the stitching, and the elastic bands extending long the lengths of the rows of overlapping oval stitching, provides surprisingly enhanced strength whilst maintaining the elasticity and expansion/contraction functionality required of the furniture sleeve.

In some embodiments, the stitching 118 used to join the polymeric fabric outer layer 102 with the elastomeric inner layer 104 is made from an elastic/resilient material.

Figure 9:
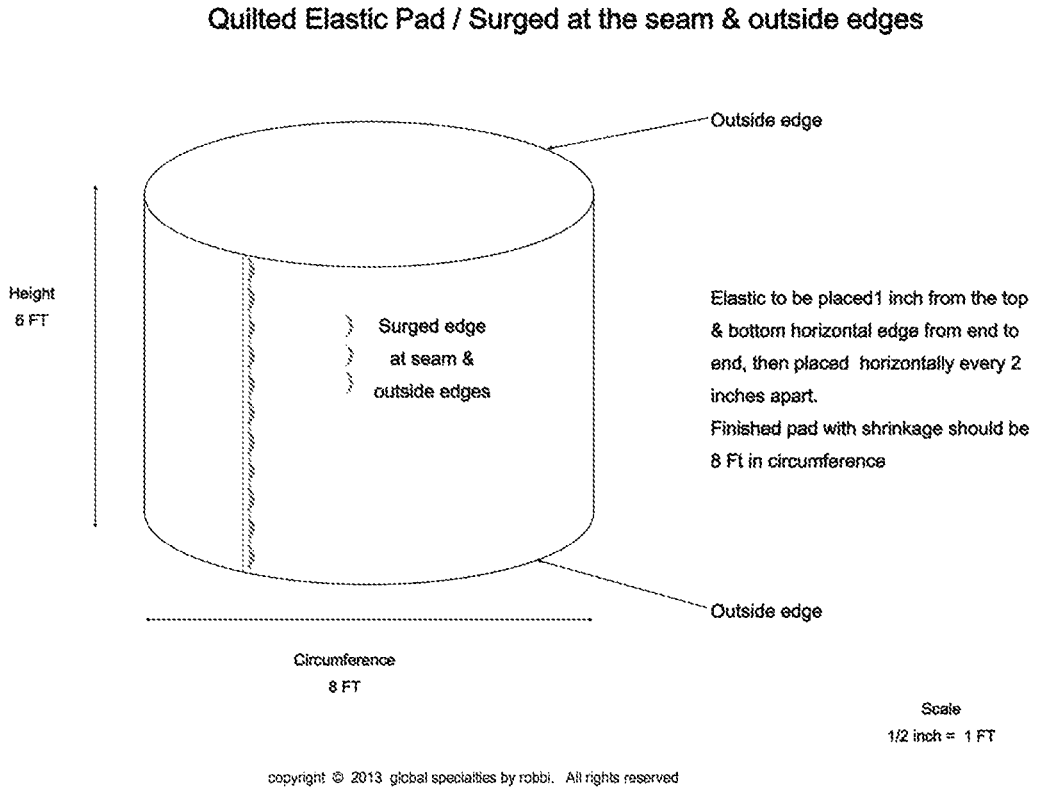
FIG. 9 is a perspective view of a furniture protective device with surged seam edges according to an embodiment.

FIG. 9 is a perspective view of a furniture protective device 900 with surged seam edges. The furniture protective device 900 is similar in construction to the furniture protective device of FIGS. 1-6 with opposing edges of the furniture protective device being stitched together with a surged edge to create the sleeve configuration. Surged edges can also be utilized along the top circumferential edge and the bottom circumferential edge.

Figure 10:
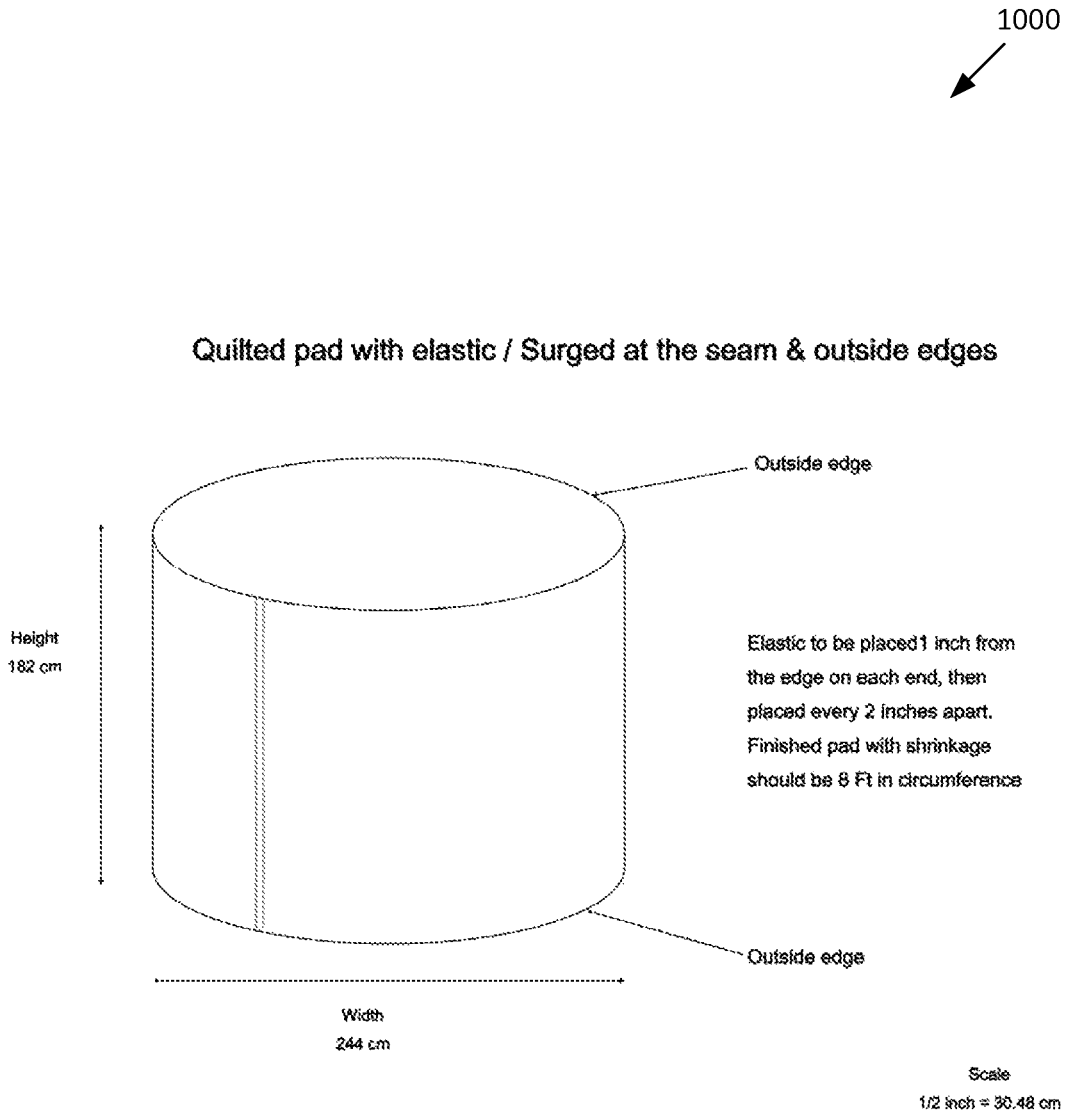
FIG. 10 is a perspective view of a furniture protective device with surged outside seam edges according to an embodiment.

FIG. 10 is a perspective view of a furniture protective device 1000 with surged outside seam edges according an embodiment. The furniture protective device 1000 is constructed similarly to the embodiments of FIGS. 1A-9, illustrating elastic banding, which can be placed at two inch intervals. Other spacing can also be utilized according to design requirements.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A furniture protective device, comprising: a tubular sleeve comprising a first open end and a second open end, the tubular sleeve comprising a layered pair of substrates comprising an elastomeric sheet stitched to a polymeric fabric sheet, wherein the elastomeric sheet is stitched to the polymeric fabric sheet with a diamond pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass an article of furniture, the elastomeric sheet resiliently biasing the tubular sleeve into a conforming relationship around the article of furniture wherein the elastomer sheet forms an inner layer of the tubular sleeve and extends from said first open end to said second open end, wherein the polymeric fabric sheet forms an outer layer of the tubular sleeve and extends from said first open end to said second open end, wherein the polymeric fabric outer layer comprises a polyester fabric, wherein the elastomeric inner layer comprises a LYCRA material, wherein said tubular sleeve is configured to expand around said article of furniture, and wherein said first open end comprises a stitched peripheral edge, wherein said stitched peripheral edge is configured to constrict said first open end when said first open end extends past an end of said article of furniture.

2. The furniture protective device according to claim 1, wherein the second open end also comprises a stitched peripheral edge which is configured to constrict said second open end when said second open end extends past an end of said article of furniture.

3. The furniture protective device according to claim 1, further comprising a pocket configured to store accessories for the article.

4. A furniture protective device, comprising: a tubular sleeve comprising a first end and a second end, the tubular sleeve comprising a layered pair of substrates comprising an elastomeric sheet stitched to a polymeric fabric sheet, wherein the elastomeric sheet is stitched to the polymeric fabric sheet with a diamond pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass an article, the elastomeric sheet resiliently biasing the tubular sleeve into a conforming relationship around the article, wherein the elastomer sheet forms an inner layer of the tubular sleeve and extends from said first end to said second end, wherein the polymeric fabric sheet forms an outer layer of the tubular sleeve and extends from said first end to said second end, wherein the polymeric fabric outer layer is made from a polyester fabric, wherein the elastomeric inner layer is made from a LYCRA material, wherein said tubular sleeve is configured to expand around said article of furniture, and wherein said second end comprises a bottom side wall that encloses the second end, wherein said bottom sidewall is constructed with stitching to create cells which provide padding and structure to the bottom sidewall, such that said bottom sidewall is configured to provide an additional protective surface for covering an end of the article of furniture.

5. The furniture protective device according to claim 4, wherein the first end is open and comprises a stitched peripheral edge which is configured to constrict said first end when said first open end extends past an end of said article of furniture.

6. The furniture protective device according to claim 4, wherein cells of the bottom sidewall are chevron shaped sections.

7. The furniture protective device according to claim 4, further comprising a plurality of elastomeric bands that extend longitudinally along a central axis of the tubular sleeve in between the elastomeric sheet and the polymeric fabric sheet.

8. The furniture protective device according to claim 7, wherein the plurality of elastomeric bands extend between the first end and the second end.

9. A furniture protective device, comprising: a tubular sleeve comprising a first open end and a second open end, the tubular sleeve comprising a layered pair of substrates comprising an elastomeric sheet stitched to a polymeric fabric sheet, wherein the elastomeric sheet is stitched to the polymeric fabric sheet with a pattern that forms cells, wherein each of the cells comprises a ruching of polymeric fabric sheet material, further wherein the cells can expand when the furniture protective device is stretched due to the ruching of polymeric fabric sheet material allowing the tubular sleeve to expand to encompass an article of furniture, the elastomeric sheet resiliently biasing the tubular sleeve into a conforming relationship around the article of furniture, wherein the elastomer sheet forms an inner layer of the tubular sleeve and extends from said first open end to said second open end, wherein the polymeric fabric sheet forms an outer layer of the tubular sleeve and extends from said first open end to said second open end, wherein said tubular sleeve is configured to expand around said article of furniture, and wherein said first open end comprises a stitched peripheral edge, wherein said stitched peripheral edge is configured to constrict said first open end when said first open end extends past an end of said article of furniture.

10. The device of claim 9, wherein said elastomeric sheet is stitched to the polymeric fabric sheet with overlapping oval shaped stitches.

11. The device of claim 10, wherein said overlapping oval shaped stitches comprises a plurality of spaced apart rows of overlapping oval stitches.

12. The device of claim 11, wherein each row of overlapping oval shaped stitches extends circumferentially around the tubular sleeve, and wherein a length or stripe of material absent said stitching extends between said rows.

13. The device of claim 12, where said rows of overlapping oval stitches extend substantially in parallel and wherein a pair of spaced apart elastic bands extend along each row, one of said pair of elastic bands extending along a first outer side edge region of said row of oval stitches and the other of said pair of elastic bands extending between the elastomeric sheet and polymeric fabric sheet along a second outer side edge region of said row, opposite said first side edge region, wherein said elastic bands are configured to constrict the overall size of the device when the device is not in use.

14. The furniture protective device of claim 1, wherein said tubular sleeve further comprises a plurality of elastic bands between the elastomeric sheet and polymeric fabric sheet, wherein said elastic bands are configured to constrict the overall size of the device when the device is not in use, wherein said elastic bands extend longitudinally from said first open end to the second open end along a central axis of said sleeve and/or circumferentially around said central axis.

15. The furniture protective device of claim 4, wherein said tubular sleeve further comprises a plurality of elastic bands between the elastomeric sheet and polymeric fabric sheet, wherein said elastic bands are configured to constrict the overall size of the device when the device is not in use, wherein said elastic bands extend longitudinally from said first open end to the second open end along a central axis of said sleeve and/or circumferentially around said central axis.

16. The furniture protective device of claim 12, wherein the polymeric fabric outer layer is made from a polyester fabric, and wherein the elastomeric inner layer is made from a LYCRA material.

* * * * *